US006668526B2

(12) United States Patent
Schmidt

(10) Patent No.: US 6,668,526 B2
(45) Date of Patent: Dec. 30, 2003

(54) WEB CENTERING SYSTEM

(75) Inventor: Josef Schmidt, Green Oaks, IL (US)

(73) Assignee: Baxter International, Inc., Deerfield, IL (US)

( * ) Notice: Subject to any disclaimer, the term of this patent is extended or adjusted under 35 U.S.C. 154(b) by 0 days.

(21) Appl. No.: 09/843,540

(22) Filed: Apr. 27, 2001

(65) Prior Publication Data

US 2002/0158100 A1 Oct. 31, 2002

(51) Int. Cl.[7] ..... B65B 9/20
(52) U.S. Cl. ..... 53/551; 226/21
(58) Field of Search ..... 53/551, 552, 550, 53/64; 226/21

(56) References Cited

U.S. PATENT DOCUMENTS

| | | | | |
|---|---|---|---|---|
| 3,680,446 A | | 8/1972 | James et al. | |
| 4,090,432 A | * | 5/1978 | Hobart | 93/20 |
| 4,630,429 A | | 12/1986 | Christine | |
| 4,695,337 A | | 9/1987 | Christine | |
| 4,708,045 A | | 11/1987 | Posey et al. | |
| 4,761,197 A | | 8/1988 | Christine et al. | |
| 4,779,397 A | | 10/1988 | Christine et al. | |
| 4,794,750 A | | 1/1989 | Schmidt et al. | |
| 4,829,746 A | | 5/1989 | Schmidt et al. | |
| 4,887,973 A | | 12/1989 | Susini et al. | |
| 4,909,425 A | | 3/1990 | Susini et al. | |
| 4,924,655 A | | 5/1990 | Posey | |
| 4,964,944 A | | 10/1990 | Christine et al. | |
| 5,133,172 A | | 7/1992 | Soubrier | |
| 5,174,096 A | * | 12/1992 | Fukuda | 53/551 |
| 5,347,791 A | | 9/1994 | Ginzl et al. | |
| 5,558,263 A | * | 9/1996 | Long | 226/114 |
| 5,667,123 A | * | 9/1997 | Fukuda | 226/21 |
| 5,833,106 A | | 11/1998 | Harris | |
| 6,044,615 A | * | 4/2000 | Fukuda | 53/64 |

FOREIGN PATENT DOCUMENTS

EP 0 307 125 B1 2/1993

* cited by examiner

*Primary Examiner*—Rinaldi I. Rada
*Assistant Examiner*—Gloria R. Weeks
(74) *Attorney, Agent, or Firm*—Mark J. Buonaiuto; Matthew Gryzlo

(57) ABSTRACT

An in-line web-centering apparatus for centering a web of material in an aseptic internal area of a form-fill-seal packaging machine. The web-centering apparatus has a support member, a tracking assembly, and an alignment mechanism, each contained within the internal aseptic area of the packaging machine. The support member is internally fixed to the form-fill-seal packaging machine. The tracking assembly is mounted to the support member and pivots about the support member. The pivoting of the tracking assembly positions the tracking assembly at an angle with respect to the support member, such that when the alignment mechanism is activated the angle of the tracking assembly is modified, thereby adjusting a flow path of the web of material in the packaging machine.

28 Claims, 6 Drawing Sheets

WEB CENTERING SYSTEM

TECHNICAL FIELD

The present invention relates generally to a mechanism for adjusting the direction of a web of material in a packaging machine, and more specifically to an assembly for centering or tracking a web of film in an aseptic environment of a form-fill-seal packaging machine.

BACKGROUND OF THE INVENTION

One type of packaging machine is a form-fill-seal packaging machine. Form-fill-seal packaging machines are typically utilized to package a product in a flexible container. To this end, form-fill-seal packaging machines are used to seal pharmaceuticals, foods, liquids, magazines, cosmetics, preboxed goods, and numerous other items in flexible containers. The form-fill-seal packaging machine provides an apparatus for packaging these and many other products in an inexpensive and efficient manner.

Pursuant to FDA requirements, certain pharmaceuticals packaged in form-fill-seal packages are traditionally sterilized in a post-packaging autoclaving step. The post-packaging step includes placing the sealed package containing the pharmaceutical in an autoclave and steam sterilizing or heating the package and its contents to a required temperature, which is often approximately 250° F., for a prescribed period of time. This sterilization step operates to kill bacteria and other contaminants found inside the package, whether on the inner layer of film or within the pharmaceutical itself.

Certain packaged pharmaceuticals, however, cannot be sterilized in such a manner. This is because the intense heat required to kill the bacteria in the autoclaving process destroys or renders useless certain pharmaceuticals. As such, a different method of sterilization must be employed when packaging these types of pharmaceuticals.

One method of packaging heat sensitive pharmaceuticals is to first sterilize the pharmaceutical with a means other than intense heat, often through filtering, and then to package the pharmaceutical in an aseptic environment.

To date, the assignee of the present invention has developed several improvements in aseptic form-fill-seal packaging. Such improvements include at least: U.S. Pat. No. 4,761,197 (directed to an apparatus for sealing a web of film); U.S. Pat. No. 4,695,337 (directed to an apparatus and method for attaching a fitment to a web of film); U.S. Pat. No. 4,829,746 (directed to an apparatus for placing a web of film under tension); U.S. Pat. No. 4,888,155 (directed to an apparatus for sterilizing film and like packaging material); U.S. Pat. No. 4,744,845 (directed to an apparatus for splicing film together); and, U.S. Pat. No. 4,783,947 (directed to an apparatus for removing liquid and residue from a web of film).

Web tracking assemblies utilized in conventional form-fill-seal packaging machines (i.e., form-fill-seal packaging machines that do not include an aseptic packaging environment) are generally not suitable for use in an aseptic environment. For example, two conventional web tracking means are disclosed in U.S. Pat. No. 3,680,446, issued to James et al., and U.S. Pat. No. 5,833,106, issued to Harris. The '446 patent issued to James et al. discloses a tracking system including a shiftable web guide roller having adjustable air cylinders mounted at its opposite ends for independently adjusting the ends of the roller (see FIG. 1 of the '446 patent). The '106 patent issued to Harris discloses an equalizing roll utilizing a common-axis shaft mounted horizontally on two bearings at its end for support, and a roller or sleeve mounted on the shaft. The sleeve has a single bearing mounted in the center of the sleeve with convex and concave portions that allows the sleeve to laterally rotate on the central bearing (see FIG. 5 of the '106 patent). Such web tracking devices of the '446 and '106 patents are likely not appropriate for aseptic environments because of the number of moving parts and the areas for gathering particulate bacteria matter.

Thus, improvement in tracking the web of film as it enters the former in aseptic form-fill-seal packaging machines would be useful. To date, form-fill-seal packaging machines designed for aseptic packaging utilize a tracking assembly located adjacent the unwind, and outside the aseptic environment. This tracking assembly, however, is not located adjacent the former, but rather is located upstream of the ultimate package forming process. Thus, occasionally difficulties are encountered in attempting to track the film within the aseptic environment. As a result of this web-tracking limitation, much waste, inefficiency, and increased manufacturing costs are encountered by packagers in this industry. Specifically, when the web tracking is not balanced, and the web is not aligned through the former, each package that is created generally must be discarded due to improper overlap of the layers of film in the seal area. This may result in wasted film and wasted pharmaceutical material. It also may result in increased operator expense to observe the misaligned film, to select and discard the poorly formed packages, and to attempt to re-align the film. Further, severe cases of misaligned film may result in down time for the machine. All of the above increases the manufacturing costs of packaging such pharmaceuticals.

Thus, a means for tracking the web of film in the aseptic environment of a packaging machine is essential.

SUMMARY OF THE INVENTION

The web-centering apparatus of the present invention provides an assembly for tracking a web of material within an internal aseptic area of a form-fill-seal packaging machine. Generally, the web-centering apparatus comprises a support member, a tracking assembly, and an alignment mechanism. While the web-centering apparatus is located within the aseptic area of the packaging machine, certain components of the web-centering assembly are sealed off from the aseptic area in order to maintain the integrity of the aseptic environment.

According to one aspect of the present invention, the packaging machine has a former, a filler and a sealer located within the internal aseptic area of the packaging machine. The former forms bags from a web of material; the filler fills the bags with a substance; and, the sealer seals the bags to enclose the substance within the bags.

According to another aspect of the present invention, the support member is fixed to the form-fill-seal packaging machine within an interior aseptic environment of the form-fill-seal packaging machine, and the tracking assembly is rotatedly mounted to the support member in the aseptic environment of the form-fill-seal packaging machine. To provide for the mounting engagement between the support member and the tracking assembly, one of either the support member or the tracking assembly has a shaft member depending therefrom, and the other of either the support member or the tracking assembly has an engaging receptacle for the shaft member. The shaft member is seated in the engaging receptacle and pivots within the engaging receptacle. The pivoting of the shaft member provides angular displacement of the tracking assembly.

According to another aspect of the present invention, an engagement surface of each of the shaft member and the receptacle is sealed off from the aseptic environment of the form-fill-seal packaging machine.

According to another aspect of the present invention, a portion of the engaging surfaces between the shaft member and the receptacle are sealed off from the internal aseptic environment of the form-fill-seal packaging machine with a first gasket. A second gasket member seals off a second end of the receptacle.

According to another aspect of the present invention, the web tracking apparatus has a bearing surface between the pivot shaft and the receptacle. The bearing surface is sealed off from the aseptic environment with gaskets.

According to another aspect of the present invention, the tracking assembly comprises an engaging member and a roller member connected to the engaging member. The roller member is adapted to contact the web of material, and the engaging member pivots about the support member.

According to another aspect of the present invention, the tracking assembly is positioned at an angle with respect to the support member. The angle of the tracking assembly is modified when the tracking assembly is pivoted about the support member. Modification of the angle of the tracking assembly adjusts the flow path of the web of material.

According to another aspect of the present invention, the alignment mechanism comprises a first adjustment member, a mating second adjustment member, and an operator shaft. The first adjustment member is connected to the operator shaft, the second adjustment member is fixed to the tracking assembly, and the first and second adjustment members engage each other. The operator shaft controls any movement of the first adjustment member. Through movement of the first adjustment member, which engages the second adjustment member, the tracking assembly is pivoted.

According to another aspect of the present invention, the first adjustment member comprises a worm gear connected to the operator shaft, and the second adjustment member comprises a mating spur gear fixed to the tracking assembly. The spur gear is driven by the worm gear to effectuate pivotal rotation of the tracking assembly about the support member.

According to another aspect of the present invention, a clutch mechanism is removably connected to the alignment mechanism. The clutch mechanism engages the operator shaft and allows an operator outside of the aseptic interior environment of the form-fill-seal packaging machine to rotate the operator shaft and pivot the tracking assembly to adjust the tracking of the web of material.

According to another aspect of the present invention, the roller member of the tracking assembly comprises a shaft and a roller. The shaft is secured to the engaging member, and the roller is capable of rotating about the shaft. The roller member pivots with the tracking assembly about the support member when the tracking assembly is pivoted thereabout. Further, the roller member contacts the web of material.

According to another aspect of the present invention, the tracking mechanism is located in the internal aseptic area of the packaging machine immediately upstream of the former. The tracking mechanism contacts the web of material and pivots within the aseptic area of the packaging machine. Further, the tracking mechanism is connected to an external control unit that controls the pivoting of the tracking mechanism. And, the pivoting of the tracking mechanism alters an angle of contact between the tracking mechanism and the web of material to center the web of material entering the former.

According to another aspect of the present invention, a container for holding a pharmaceutical is manufactured in an aseptic form-fill-seal packaging machine having a web centering system made in accordance with the present invention.

According to yet another aspect of the present invention, a process for centering a web of material in an aseptic environment of a form-fill-seal packaging machine is provided utilizing the web centering system made in accordance with the present invention.

Accordingly, a web centering system made in accordance with the present invention provides an inexpensive, easily manufactured, and efficient assembly which eliminates the drawbacks associated with aseptic form-fill-seal packaging machines.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
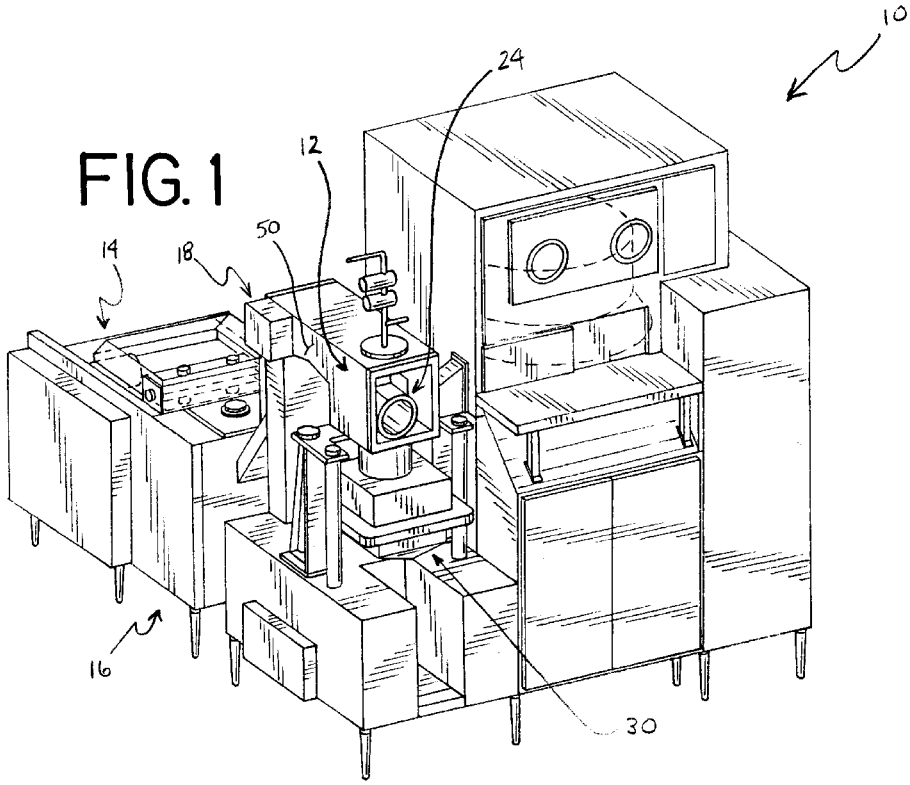
FIG. 1 is a perspective view of a form-fill-seal packaging machine having a web centering apparatus of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
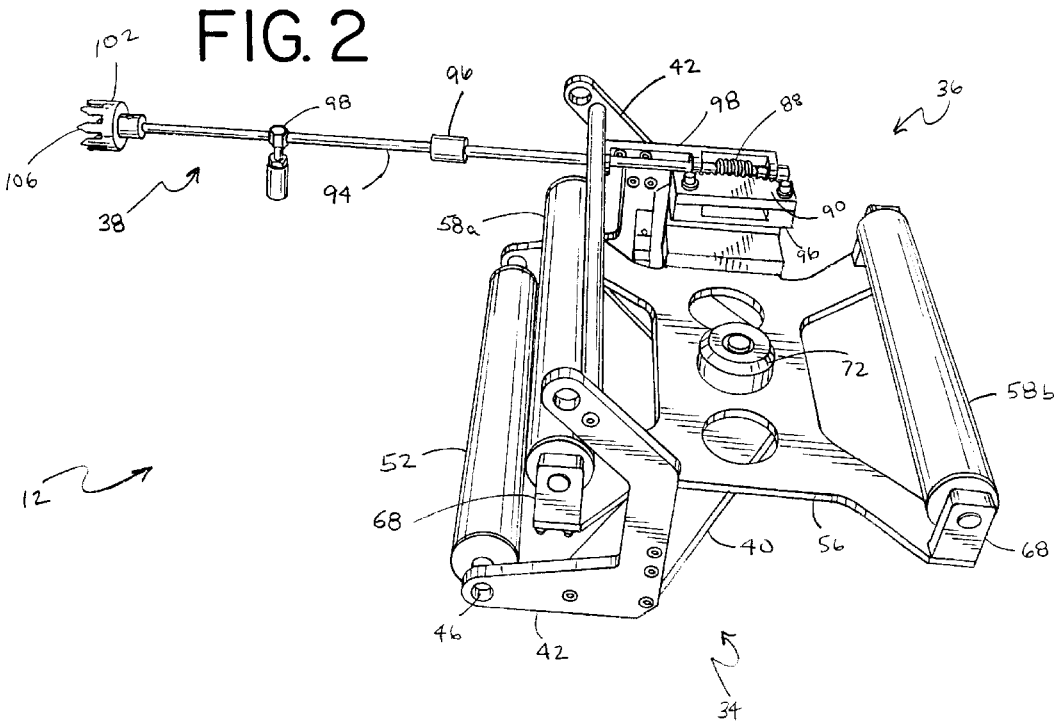
FIG. 2 is a perspective view of the web centering apparatus of the present invention.
Figure 8:
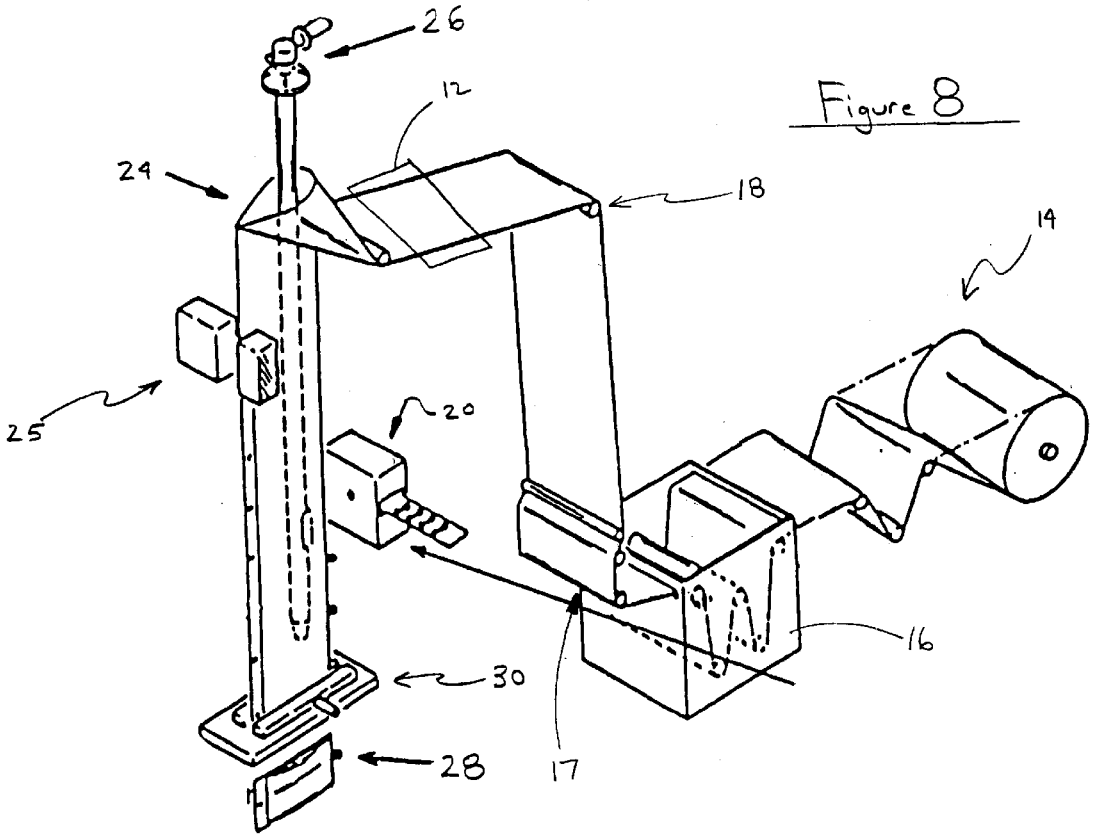

Referring now in detail to the Figures, and specifically to FIGS. 1 and 2, there is shown an aseptic form-fill-seal packaging machine 10 in FIG. 1, a schematic of the web-centering and forming processes in FIG. 8, and a web tracking assembly 12 for the aseptic form-fill-seal packaging machine in FIG. 2. The aseptic form-fill-seal packaging machine 10 generally includes an unwind section 14, a film sterilizing section 16, a film drying section (17), an idler roller/dancer roller section 18, a nipped drive roller assembly section (not shown), a fitment attaching assembly section (20), a forming assembly section 24, a fin seal assembly section (25), a filling assembly section (26), an end sealing/cutting assembly section 30, and a delivery section (not shown). Each of these assemblies downstream of the unwind section 14 is contained within the internal aseptic environment of the form-fill-seal packaging machine 10.

The function of the various assemblies of the form-fill-seal packaging machine 10 is as such: the forming assembly 24 is provided to form tubes from the web of material that ultimately becomes the flexible container or bag 28; the fin seal assembly 25 provides the longitudinal seal on the flexible container, thereby longitudinally sealing the formed tube; the filling assembly 26 includes a filler that fills the flexible containers with a substance, that being a liquid pharmaceutical in the present preferred application; and, the end sealing/cutting assembly 30 contains a cutting and sealing head that seals the ends of the flexible containers to enclose the filled substance within the flexible container.

In the preferred embodiment of the present invention, the web tracking or centering apparatus 12 comprises a support assembly 34, a tracking assembly 36, and an alignment mechanism 38. The web tracking apparatus 12 is provided to be assembled and operational within an existing internal aseptic area of an aseptic packaging machine 10. In the preferred embodiment, the web tracking apparatus 12 is located in the aseptic area immediately upstream of the former assembly 24 to provide the most effective tracking for the web of film as it enters the former.

Figure 3:
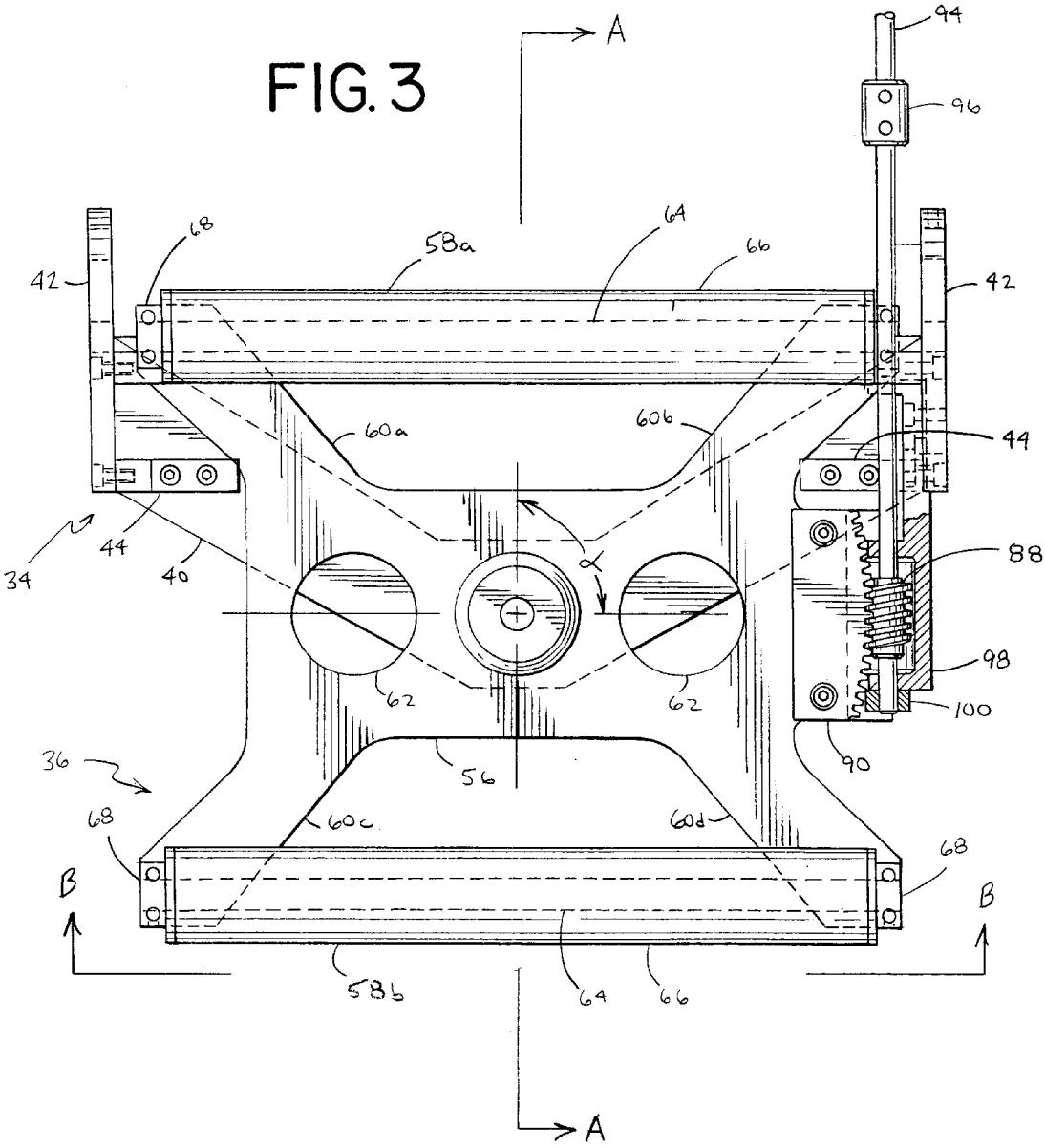
FIG. 3 is a top plan view of the web centering apparatus of FIG. 1.
Figure 4:
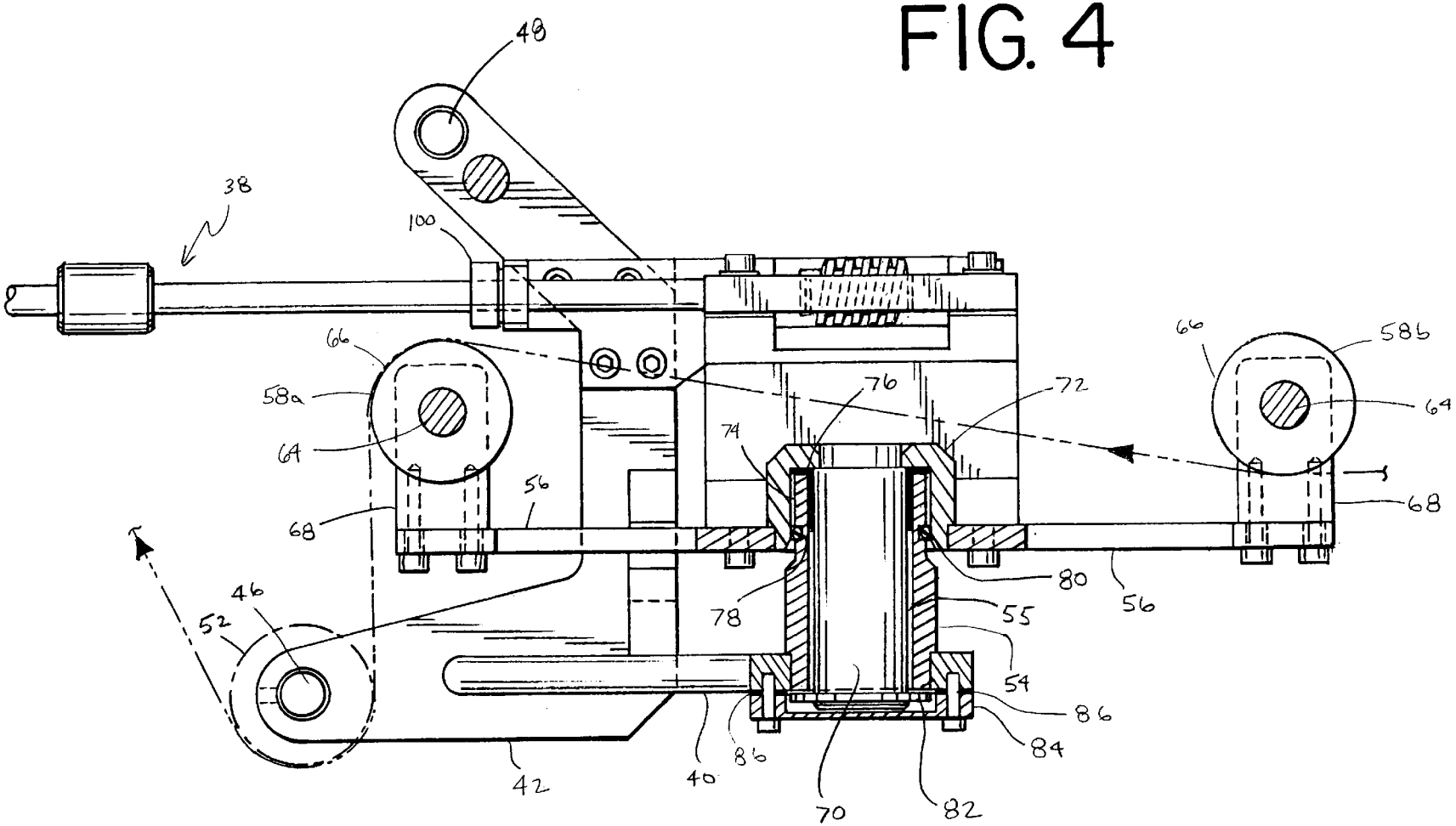
FIG. 4 is a cross-sectional side elevation view taken along line A—A of FIG. 3.
Figure 5:
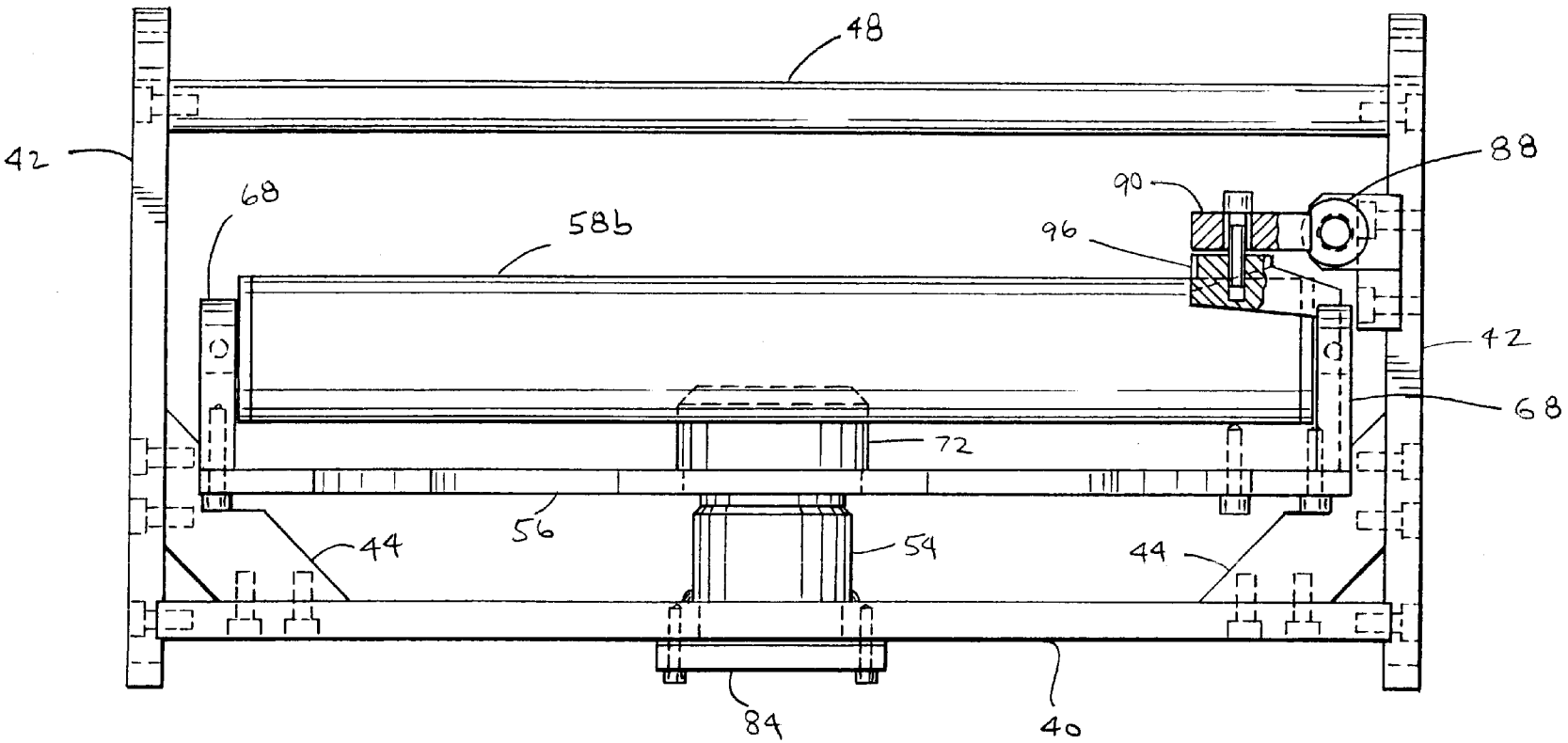
FIG. 5 is a front elevation view taken along line B—B of FIG. 3.

As shown in FIGS. 2–4, the support assembly 34 of the present invention comprises a support member 40 which is internally fixed within the internal aseptic area of the form-fill-seal packaging machine 10. In the preferred embodiment, the support member 40 is a "V" shaped stainless steel plate and is attached to a pair of side members 42 with stainless steel screws. A gusset member 44 is secured to both the support member 40 and each of the side members 42, respectively, to provide additional rigidity to the support member 40. The side members 42 are internally secured to the frame 50 of the packaging machine 10 with the use of two existing support shafts 46, 48 that span between the internal walls of the packaging machine frame 50. The lower support shaft 46 also operates as an idler roller 52 for the film as the film enters the tracking assembly 12.

As best shown in FIG. 4, the support member 40 has an engaging receptacle 54 depending therefrom. In the preferred embodiment, the receptacle 54 is a tubular member having an internal cavity 55 that is welded to the support member 40. The cavity 55 is cylindrical in shape and thus has an internal diameter associated therewith. As will be described in greater detail herein, the engaging receptacle 54 operates to mate with a member of the tracking assembly 36.

Referring now to FIGS. 2–4, the tracking assembly 36 of the web centering apparatus 10 is rotatedly mounted to the support member 40, and generally comprises an engaging member 56, and a roller member 58 depending from the engaging member 56. The engaging member 56 is generally a stainless steel plate. In the preferred embodiment, the engaging member 56 has four arms 60*a*–60*d* in the form of an "X" shape (see FIG. 3). The preferred embodiment of the engaging member 56 also has two apertures 62 through the body of the engaging member 56. The arms 60*a*–60*d* and the apertures 62 allow for decreased surface area and increased air flow about the tracking assembly 36 during the hydrogen peroxide fog sterilization process for the internal aseptic area of the packaging machine. Without the allowance for such air flow capabilities, either contaminants may remain in the aseptic area after sterilization, or an absolute cleansing of the hydrogen peroxide remnants may not be possible in a timely manner.

In the preferred embodiment shown in the Figures, first and second roller members 58*a*, 58*b* are utilized. The roller members 58 are adapted to contact the web of material, and are also identified as contact members 58. While in the preferred embodiment the roller members 58 spin about the shaft 64, it is understood that the roller members 58 may be stationary members, and in fact do not have to have a circular cross-section. A piece of flat stock or any other geometric member that can contact the web of material is understood to be within the meaning of a roller member 58 of the present invention. The first roller member 58*a* is connected to the engaging member 56 adjacent a first end of the engaging member 56, and the second roller member 58*b* is connected to the engaging member 56 adjacent a second end of the engaging member 56. The first end of the engaging member 56 is located at the downstream end of the engaging member 56, while the second end of the engaging member 56 is located at the upstream end of the engaging member 56. Each roller member 58*a*, 58*b* comprises a shaft 64 and a roller 66. The roller 66 is capable of rotating about the shaft 64 through the use of plastic bushings. The plastic bushings are non-lubricated and are capable of withstanding the corrosive elements of hydrogen peroxide during the daily sanitization process. Additionally, the plastic bushings are open to allow the hydrogen peroxide fog to enter all of the areas for cleaning. The shaft 64 is secured to a roller support 68 at each end of the shaft 64 with set screws. Further, the roller supports 68 depend from and are secured to the engaging member 56 at approximately the end of each arm 60*a*–60*d* of the engaging member 56, respectively (see FIG. 3). Thus, the roller supports 68 secure the roller members 58*a*, 58*b* to the engaging member 56. While the use of two roller members 58 provides increased tracking capabilities for the web, it has been found that one roller member 58 may suffice. When the engaging member 56 rotates within the engaging receptacle 54, both roller members 58*a*, 58*b* of the present invention pivot or rotate simultaneously with the engaging member 56. Thus, both a first upstream roller and a second downstream roller are utilized to track the film.

With reference to FIG. 3, the web-centering apparatus 12 is located in-line with the web of film material as it passes through the form-fill-seal packaging machine 10. Further, the web-centering apparatus pivots substantially about a centerline of the packaging machine, the centerline of the packaging machine approximately being a centerline of the web of film material being fed into the former.

As best shown in FIG. 4, the engaging member 56 has a shaft member 70 depending from the bottom of the engaging member 56. The shaft member 70 operates as a first rotating member 70. In the preferred embodiment, the shaft member 70 is a cylindrical member made of stainless steel round stock that is welded to the engaging member 56. Further, in the preferred embodiment, a projection 72 extends from the engaging member 56. The projection 72 extends the bottom surface of the engaging member 56 upward a distance from the generally planar bottom surface of the engaging member 56. FIG. 4 illustrates that the projection 72 further creates a cavity within the engaging member 56. The projection 72 of the preferred embodiment is manufactured utilizing a cylindrical member 72 welded to the planar surface of the engaging member 56. The cylindrical member 72 has an internal diameter. In this embodiment, the shaft member 70 depends from the bottom of the projection 72 and partially extends within the cavity of the projection 72. A cylindrical gap 74 extends between the shaft member 70 and the internal wall of the projection 72.

As explained above, in the preferred embodiment the shaft member 70 depends from the engaging member 56, and the engaging receptacle 54 depends from the support member 40. Conversely, however, the shaft member 70 may depend from the support member 40 and the engaging receptacle 54 may depend from the engaging member 56. As such, one of either the support member 40 or the tracking assembly 36 has a shaft member 70 depending therefrom, and the other of either the support member 40 or the tracking assembly 36 has an engaging receptacle 54 for the shaft member 70.

Irrespective of the specific depending member for each of the shaft member 70 and the engaging receptacle 54, to form the web tracking apparatus 12 of the present invention the tracking assembly 36 is mounted to the support assembly 34 via the shaft member 70 being seated in the engaging receptacle 54, and with the shaft member 70 being capable of pivoting within the receptacle 54. Such engagement between engaging surfaces of the tracking assembly 36 and the support assembly 34 provides rotational or pivoting capabilities of the tracking assembly 36 about the support assembly 34. Initially, the tracking assembly 36 is positioned at an angle ($\alpha$) with respect to the support assembly 34. When the tracking assembly 36 is pivoted or rotated about the support assembly 34, the angle ($\alpha$) of the tracking assembly 36 is modified. Modification of the angle ($\alpha$) of the tracking assembly 36 provides angular displacement of the tracking assembly 36, thereby adjusting the angle of the roller members 58 which contact the web of material, and ultimately adjusting the flow path of the web of material entering the former assembly 24 to allow the film to be centered as it enters the former assembly 24. As explained further herein, the alignment mechanism 38 controls the angle of rotation ($\alpha$) between the support member 40 and the tracking assembly 36.

In the seating of the shaft member 70 in the engaging receptacle 54 of the support assembly 34, a plastic bushing 76 operating as a bearing surface is placed between the shaft member 70 and the inner wall of the engaging receptacle 54. The bushing 76 also has a flange to properly seat and locate the surfaces between the inner wall of the cavity of the projection 72 of the engaging member 56, and a top surface of the tubular member of the receptacle 54. Because only slight movement of the tracking assembly is effectuated, a bushing is not critical, and the surfaces of the engaging receptacle and the shaft member may be manufactured to operate as bearing surfaces.

The engaging receptacle 54 also has a groove 78 machined in its outer diameter. A first gasket member 80 is seated in the groove 78. In the preferred embodiment, the first gasket 80 is an silicon rubber O-Ring. When the engaging member 56 engages the engaging receptacle 54, the first gasket 80 extends between the engaging member 56 and the support member 40. Specifically, the O-Ring 80 in the groove 78 of the engaging receptacle 54 engages the inner wall of the cavity of the projection 72 to seal a first end of the receptacle 54. Thus, a portion of the mating area of the engaging surfaces between the pivot shaft 70 and the receptacle 54 adjacent a first end of the receptacle is sealed off from the internal aseptic environment of the form-fill-seal packaging machine 10.

After the shaft 70 is seated in the opening of the engaging receptacle 54, a retainer 82 is secured to the shaft 70 to prevent the shaft 70 from disengaging from the receptacle 54. In the preferred embodiment, the retainer 82 is a retaining ring. The retainer 82 vertically fixes the support assembly 34 to the tracking assembly 36, but the retainer 82 does not prevent pivotal or rotational displacement between the two assemblies.

Once the tracking assembly 36 is rotatedly fixed to the support assembly 34 with the retaining ring 82, a cover 84 and a second gasket member 86 are used to seal the second end of the receptacle 54. Specifically, in the preferred embodiment the second gasket member 86, preferably made of silicon rubber, is fitted between a bottom surface of the support member 40 and the cover 84 to seal off the mating areas of the pivotal engagement surfaces between the pivot shaft 70 and a second end of the receptacle 54 from the internal aseptic environment of the form-fill-seal packaging machine 10. Sealing off the first and second ends of the cavity areas between the pivot shaft and the mating receptacle creates a sealed off area for the pivotal engagement surfaces separate from and within the aseptic environment of the packaging machine. To maintain the aseptic environment of the packaging machine, the pivotal engagement bearing surfaces between the pivot shaft and engaging receptacle must be located within that sealed-off area.

Figure 6:
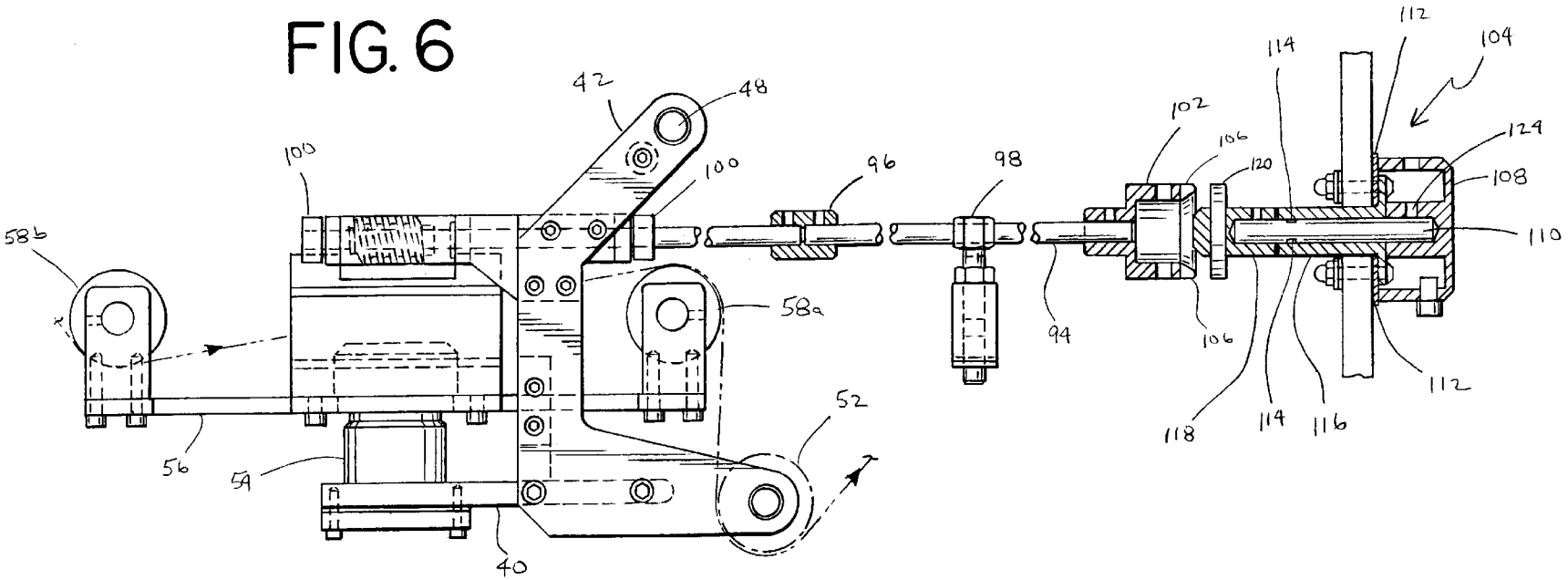
FIG. 6 is a partial side view of the alignment mechanism of the web centering apparatus of the present invention.

As shown in FIGS. 2, 3, 5 and 6, the web tracking apparatus 12 of the present invention further comprises an alignment mechanism 38 contained within the aseptic area of the form-fill-seal packaging machine 10. The alignment mechanism is connected to the tracking assembly 36 and is utilized to control and effectuate pivotal rotation of the tracking assembly 36 about the support assembly 34. The alignment mechanism 38 comprises a first alignment or adjustment member 88, a mating second alignment or adjustment member 90, and a means for manipulating the first alignment member. The alignment mechanism 38 further comprises an operator shaft 94 connected to the first adjustment member 88. As shown in FIGS. 2 and 6, because of the length of the operator shaft 94 in the preferred embodiment, it is formed of two pieces connected by a coupling 96. The operator shaft 94 is fixed in place with the use of shaft guides 98 and shaft collars 100, and thus is only capable of rotational movement. The shaft guides 98 operate to prevent transverse movement of the operator shaft 94, while the shaft collars 100 prevent lateral movement of the operator shaft 94. The rotational movement of the operator shaft 94 controls rotational movement of the first adjustment member 88.

In the preferred embodiment, the first alignment member 88 comprises a first gear member connected adjacent a distal end of the operator shaft 94. The first gear member is preferably a single-threaded, 16 pitch, stainless steel precision worm gear having a lead of 0.1963 inch, a lead angle of 5°-43', and a pressure angle of 14-½°. The second alignment member 90 comprises a second gear member that mates with the worm gear 88. The second gear member is made of from a mating spur gear having 180 teeth about its circumference, however, the spur gear utilized in the preferred embodiment is a partial spur gear of the identified gear, and only has approximately 18 of the 180 teeth. The partial spur gear 90 is fixed to a bracket 96 connected to the engaging member 56 of the tracking assembly 36. The first gear member 88 is manipulated by rotation of the operator shaft 94. Further, the worm gear 88 drives the spur gear 90 to effectuate rotation of the tracking assembly 36 about the support assembly 34 via the pivot shaft 70. Use of a worm gear to manipulate a spur gear provides increased control and precision in adjusting the tracking assembly 36 in fine increments. This is because the ratio between the worm gear and the spur gear should be at least 100 to 1, and in the preferred embodiment is approximately 180 to 1. However, a ratio of less than 100 to 1 will not destroy the intent of the invention. Additionally, use of the worm gear in combination with the spur gear provides a positive locking mechanism that is able to overcome any force provided by the film on the roller member. As such, the film will not cause movement of the tracking assembly.

The alignment mechanism 38 further has a first clutch member 102 connected adjacent a proximal end of the operator shaft 94, and opposite the worm gear 88. The first clutch member 102 cooperates to removably secure the alignment mechanism 38 to a controller 104 located outside the aseptic area of the form-fill-seal packaging machine. The first clutch member 102 has a plurality of fingers 106 which allow it to engage the controller 104. In the preferred embodiment, the alignment mechanism 38 is maintained within the aseptic environment and is sealed from a portion of the controller 104, which is located outside the aseptic environment.

As shown in FIG. 6, the controller 104 has a knob 108, a shaft 110, a first controller gasket 112, a second controller gasket 114, a bushing 116, a second clutch member 118, and a pin 120. In assembly of the controller 104, the bushing 116 has a hollowed out cylindrical portion and a flange portion. The hollowed out cylindrical portion is fitted through an aperture in the frame of the packaging machine 10, and the flange portion is located against the outside of the frame of the packaging machine, with the first controller gasket 112 being located between the bushing 116 and the packaging machine 10. The frame of the packaging machine separates the aseptic environment from the non-aseptic environment. The controller shaft 110 is fitted within the hollowed out cylindrical portion of the bushing 116. Next, the knob 108 is engagingly fitted on one end of the shaft 110, and is fixed to the shaft 110 with a set screw 124. The outer portion of the knob 108 also engages the first controller gasket 112 in a sealing manner.

The shaft 110 and the cylindrical portion of the bushing 116 extend inside the aseptic environment of the packaging machine 10. Along with the first controller gasket 112, the second controller gasket 114 prevents external contaminants from entering the internal aseptic environment. Specifically, the second controller gasket 114 is preferably a silicon O-Ring located between the internal diameter of the hollowed out portion of the bushing 116 and the controller shaft 110 within the bushing 116. A portion of the second end of the controller shaft 110 extends beyond an outer limit of the bushing 116 and is connected to the second clutch member 118 with a set screw. The second clutch member 118 has a pin 120 which is adapted to engage the first clutch member 102 to turn the operator shaft 94. The controller assembly 104 is removably connected to the alignment mechanism, and allows an operator to rotate the operator shaft to effectuate rotation of the tracking assembly.

Figure 7:
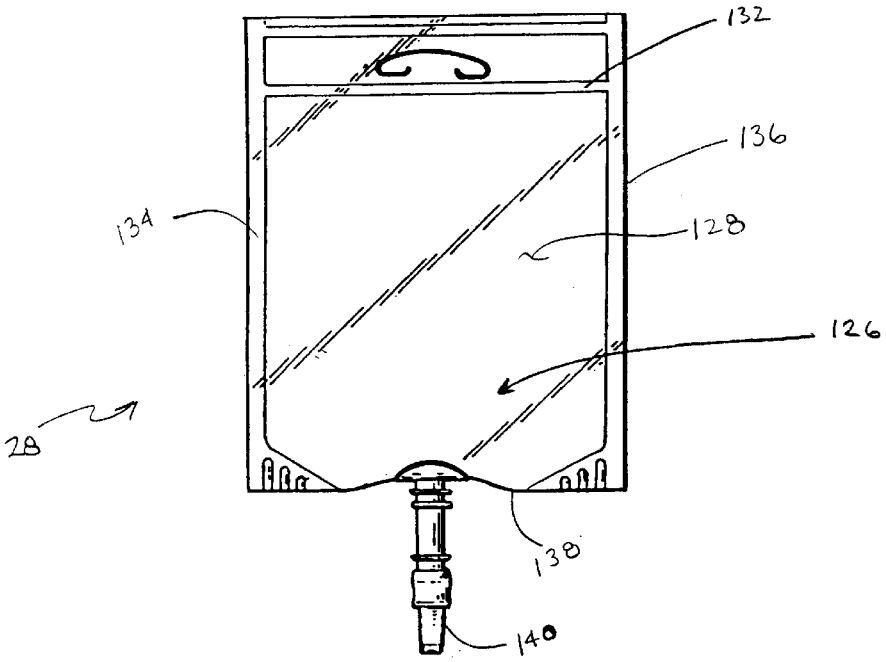
FIG. 7 is a front elevation view of a container made in a form-fill-seal packaging machine having a web centering apparatus of the present invention; and, FIG. 8 is a schematic view of the process for centering the web of material in a form-fill-seal packaging machine.

The container 28 produced by the form-fill-seal packaging machine 10 having the web tracking assembly 12 is shown in FIG. 7. The container 28 is made from a web of polymeric film material that is formed in the packaging machine. The container 28 has a cavity 126 enclosed by a first wall 128, an opposing second wall 130, and seals 132, 134, 136 about a periphery of the first and second walls 128, 130. The longitudinal seal 132 at the top of the container 28 opposes the fold area 138 at the bottom of the container 28. The joined seals 132, 134, 136 and the fold 138 create a fluid-tight chamber within the cavity 126 of the container 28. As explained later herein, a quantity of a pharmaceutical is stored within the fluid-tight chamber 126 of the container 28. With the use of the web tracking assembly 12, the peripheral edge of the first wall 128 and the second wall 130 are located substantially adjacent one another to form the longitudinal seal 132.

The container 28 also has a fitment 140. The fitment 140 is connected to the container 28 at the fold area 138, and has a passageway that cooperates with the fluid-tight chamber 126 of the container 28.

As shown in FIG. 8, a schematic is illustrated of the process for creating a container 28 in an aseptic environment of a form-fill-seal packaging machine 10 having a web centering apparatus 12. The overall process includes providing a web of material in the unwind section 14, and passing the material through a series of subassemblies in the aseptic packaging machine 10 to form the finished container 28 that is filled with the pharmaceutical. The various subassemblies of the packaging machine 10 include the film sterilization section 16, film drying section 17, dancer roller section 18, drive roller section, web centering section 12, forming section 24, fin seal section 25, fitment attaching section 20, filling section 26, end sealing section 30, and delivery section. These subassemblies have been fully disclosed herein.

Prior to usage, the internal aseptic area of the packaging machine must be sterilized each day. This is accomplished with a hydrogen peroxide fog which is passed through the aseptic area of the packaging machine. Because of the sterilization process, and the need to maintain an aseptic environment, the present invention, including the sealed off areas specifically for the moving parts is required.

Currently, three different sizes of flexible containers 28 are capable of being filled in the aseptic form-fill-seal packaging machine: 50 ml, 100 ml, and 200 ml. However, the tracking assembly of the present invention can be utilized for larger or smaller size bags.

While the specific embodiments have been illustrated and described, numerous modifications come to mind without significantly departing from the spirit of the invention, and the scope of protection is only limited by the scope of the accompanying claims.

I claim:

1. An in-line web-centering apparatus for centering a web of material in a form-fill-seal packaging machine, comprising:

a support member fixed to the form-fill-seal packaging machine in an interior aseptic environment of the packaging machine; and, a tracking assembly mounted to the support member in the aseptic environment of the form-fill-seal packaging machine, the tracking assembly having an engaging member and a contact member connected to the engaging member, the contact member being adapted to contact the web of material, wherein the tracking assembly pivots about the support member, wherein the tracking assembly is positioned at an angle with respect to the support member, and wherein the angle of the tracking assembly is modified when the tracking assembly is pivoted about the support member, the modification of the angle of the tracking assembly adjusting a flow path of the web of material.

2. The web-centering apparatus of claim 1, wherein one of either the support member or the tracking assembly has a shaft member depending therefrom, and the other of either the support member or the tracking assembly has an engaging receptacle for the shaft member.

3. The web-centering apparatus of claim 2, wherein the shaft member is seated in the engaging receptacle, and wherein the shaft member pivots within the engaging receptacle, such pivoting providing angular displacement of the tracking assembly.

4. The web-centering apparatus of claim 1, wherein an engagement surface of each of the shaft member and the receptacle is sealed off from the aseptic environment of the form-fill-seal packaging machine.

5. The web-centering apparatus of claim 1, wherein the tracking assembly is pivotally mounted to the support member in the aseptic environment of the form-fill-seal packaging machine, and wherein pivotal engagement surfaces between the support member and the tracking assembly are sealed off from the aseptic environment of the form-fill-seal packaging machine.

6. The web-centering apparatus of claim 1, further comprising an alignment mechanism connected to the tracking assembly, the alignment mechanism comprising a first adjustment member and a mating second adjustment member, the mating second adjustment member fixed to the tracking assembly, wherein the first and second adjustment members cooperate to pivot the tracking assembly.

7. The web-centering apparatus of claim 6, wherein the alignment mechanism further comprises an operator shaft connected to the first adjustment member, the operator shaft controlling the movement of the first adjustment member.

8. The web-centering apparatus of claim 7, wherein the first adjustment member comprises a worm gear connected to an operator shaft, and the second adjustment member comprises a mating spur gear fixed to the tracking assembly, and wherein the spur gear is driven by the worm gear to effectuate pivotal rotation of the tracking assembly about the support member.

9. The web-centering apparatus of claim 7, wherein the support member is fixed to the form-fill-seal packaging machine in an interior aseptic environment of the packaging machine, wherein the tracking assembly is pivotally mounted to the support member in the aseptic environment of the form-fill-seal packaging machine, wherein the alignment mechanism is fixed to the tracking assembly and contained within the aseptic environment of the form-fill-seal packaging machine, and wherein pivotal engagement surfaces between the support member and the tracking assembly are sealed off from the aseptic environment of the form-fill-seal packaging machine.

10. The web-centering apparatus of claim 9, further comprising a controller removably connected to the alignment mechanism, the controller engaging the operator shaft to allow an operator to rotate the operator shaft.

11. The web-centering apparatus of claim 1, wherein the contact member comprises a shaft and a roller, the shaft being secured to the engaging member, and the roller being capable of rotating about the shaft.

12. The web-centering apparatus of claim 1, further comprising a first contact member and a second contact member, the first contact member connected to the engaging member adjacent a first end of the engaging member, and the second contact member connected to the engaging member adjacent a second end of the engaging member, wherein the first and second contact members simultaneously pivot about the support member when the tracking assembly is pivoted.

13. An apparatus for tracking a web of material in an internal aseptic environment in a form-fill-seal packaging machine, comprising:

a support member, a tracking assembly, and an alignment mechanism, the tracking assembly having a contact member depending from an engaging member, and the contact member being adapted to contact the web of material, wherein the tracking assembly is rotatedly connected to the support member, wherein one of either the support member or the tracking assembly has a first rotation member depending therefrom, and the other of either the support member or the tracking assembly has a mating receptacle, the first rotation member communicating with and rotating within the receptacle, wherein a portion of engaging surfaces between the first rotation member and the receptacle are sealed from the internal aseptic environment of the form-fill-seal packaging machine, and wherein the alignment mechanism is connected to the tracking assembly to control the angle of rotation between the support member and the tracking assembly.

14. The web tracking apparatus of claim 13, wherein the first rotation member further comprises a pivot shaft depending from the engaging member of the tracking mechanism, and wherein the pivot shaft is seated in an opening of the receptacle of the support member.

15. The web tracking apparatus of claim 14, wherein the pivot shaft is vertically fixed to the support member with a retainer.

16. The web tracking apparatus of claim 14, wherein a first gasket extends between the engaging member and the support member to seal a first end of the receptacle.

17. The web tracking apparatus of claim 16, further comprising a second gasket member between the support member and a cover to seal a second end of the receptacle.

18. The web tracking apparatus of claim 13, further comprising a first gear member, a second gear member mating with the first gear member, and an operating shaft, wherein the first gear member is connected to the operator shaft and is manipulated by rotation of the operator shaft, and wherein the second gear member is connected to the tracking assembly and is manipulated by the first gear member, the manipulation of the second gear member causing rotation of the tracking assembly.

19. The web tracking apparatus of claim 18, wherein the first gear member is a worm gear, and wherein the second gear member is a partial spur gear, with a ratio of at least 100 to 1.

20. The web tracking apparatus of claim 13, further comprising a roller support depending from the engaging member, the support member securing the roller member to the engaging member.

21. A tracking mechanism for a form-fill-seal packaging machine having an internal aseptic area for forming, filling and sealing a bag, the tracking mechanism provided in the aseptic area upstream of a former assembly of the form-fill-seal packaging machine, the tracking mechanism comprising:

a tracking member rotatedly connected to a support member, wherein one of either the support member or the tracking member has a first rotating member and the other of either the support member or the tracking member has a mating receptacle, the tracking member being able to rotate about a specified angle of rotation with respect to the support member within the internal aseptic area of the form-fill-seal packaging machine, and wherein the mating area between the first rotating member and the mating receptacle is sealed off from the aseptic area of the form-fill-seal packaging machine.

22. The tracking mechanism of claim 21, wherein the first rotating member depends from a bottom of the tracking member, the first rotating member engaging the mating receptacle, the first rotating member having a retainer secured thereto to prevent the first rotating member from disengaging from the mating receptacle, and the first rotating member being capable of rotating within the mating receptacle.

23. The tracking mechanism of claim 22, further comprising a first sealer between the tracking mechanism and the support member, the first sealer closing off the aseptic environment of the form-fill-seal packaging machine from a first end of the mating receptacle.

24. The tracking mechanism of claim 23, wherein sealing off the first end of the mating receptacle creates a sealed off area separate from and within the aseptic environment of the form-fill-seal packaging machine.

25. The tracking mechanism of claim 22, further comprising a second sealer adjacent a second end of the mating receptacle, the second sealer closing off the aseptic environment of the form-fill-seal packaging machine from the second end of the mating receptacle.

26. The tracking mechanism of claim 21, further comprising an alignment mechanism having a first alignment member, a second alignment member fixed at one point to the tracking member and mating with the first alignment member at another point, and a means for manipulating the first alignment member, the alignment mechanism being contained within the aseptic area of the form-fill-seal packaging machine, and the alignment mechanism further being removably secured to and sealed from a controller located outside the aseptic area of the form-fill-seal packaging machine.

27. A packaging machine having an internal aseptic area, the packaging machine having a former that forms bags from a web of material, a filler that fills the bags with a substance, and a sealer that seals the bags to enclose the substance within the bags, each of the former, filler and sealer being located within the internal aseptic area of the packaging machine, the packaging machine further comprising:

a tracking mechanism located in the internal aseptic area of the packaging machine and immediately upstream of the former, the tracking mechanism contacting the web of material and pivoting within the aseptic area of the packaging machine, the tracking mechanism being connected to an external control unit that controls the pivoting of the tracking mechanism, wherein the pivoting of the tracking mechanism alters an angle of contact between the tracking mechanism and the web of material to center the web of material entering the former.

28. The packaging machine of claim 27, wherein the tracking mechanism pivots substantially about a centerline of the packaging machine, the centerline approximating a centerline of the web of material being fed into the former.

* * * * *